US009065177B2

(12) United States Patent
Alexopoulos et al.

(10) Patent No.: US 9,065,177 B2
(45) Date of Patent: Jun. 23, 2015

(54) THREE-DIMENSIONAL ANTENNA STRUCTURE

(75) Inventors: Nicolaos G. Alexopoulos, Irvine, CA (US); Yunhong Liu, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 842 days.

(21) Appl. No.: 12/985,300

(22) Filed: Jan. 5, 2011

(65) Prior Publication Data

US 2011/0095948 A1 Apr. 28, 2011

Related U.S. Application Data

(63) Continuation-in-part of application No. 12/642,360, filed on Dec. 18, 2009, now Pat. No. 8,570,222.

(60) Provisional application No. 61/293,303, filed on Jan. 8, 2010, provisional application No. 61/145,049, filed on Jan. 15, 2009.

(51) Int. Cl.

| | |
|---|---|
| ***H01Q 1/38*** | (2006.01) |
| ***H01Q 9/28*** | (2006.01) |
| ***H01Q 1/22*** | (2006.01) |
| ***H01Q 1/36*** | (2006.01) |
| ***H01Q 1/48*** | (2006.01) |
| ***H01Q 5/00*** | (2015.01) |

(52) U.S. Cl.

CPC ..... *H01Q 9/285* (2013.01); *H01Q 1/2283* (2013.01); *H01Q 1/36* (2013.01); *H01Q 1/38* (2013.01); *H01Q 1/48* (2013.01); *H01Q 5/00* (2013.01)

(58) Field of Classification Search

USPC ..... 343/700 MS, 727, 893, 859, 793

See application file for complete search history.

(56) References Cited

U.S. PATENT DOCUMENTS

| | | | | |
|---|---|---|---|---|
| 5,801,660 | A | 9/1998 | Ohtsuka et al. | |
| 2003/0222821 | A1 | 12/2003 | Mikkonen | |
| 2004/0160368 | A1 | 8/2004 | Huang | |
| 2006/0164308 | A1 * | 7/2006 | Cohen | 343/700 MS |
| 2006/0256018 | A1 | 11/2006 | Soler Castany et al. | |
| 2008/0224946 | A1 * | 9/2008 | Lee et al. | 343/895 |
| 2010/0177001 | A1 | 7/2010 | Alexopoulos | |

FOREIGN PATENT DOCUMENTS

WO 2004095635 A1 11/2004

OTHER PUBLICATIONS

European Search Report; Application No. 10015737.9-2220; Apr. 8, 2011; 4 pages.

Crnojevic-Bengin V.; "Compact 2D Hilbert Microstrip Resonators"; Microwave and Optical Technology Letters; vol. 48, No. 2; Feb. 2006; pp. 270-273.

* cited by examiner

*Primary Examiner* — Sue A Purvis
*Assistant Examiner* — Jae Kim
(74) *Attorney, Agent, or Firm* — Garlick & Markison; Randy W. Lacasse

(57) ABSTRACT

A three-dimensional antenna structure includes first and second antenna components and a via. The first antenna component is on a first layer of a substrate and the second antenna component is on a second layer of a substrate. The via couples the first antenna component to the second antenna component, wherein the first antenna overlaps, from a radial perspective, the second antenna component by an angle of overlap.

18 Claims, 18 Drawing Sheets device 10 antenna structure 38 - 44

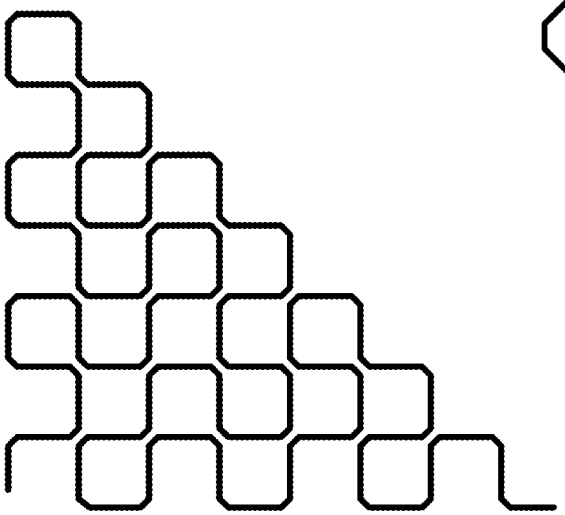
FIG. 9A s = 0.15
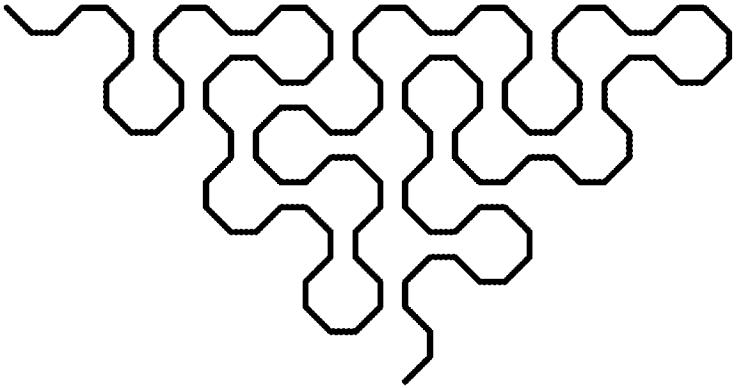
FIG. 9B s = 0.25
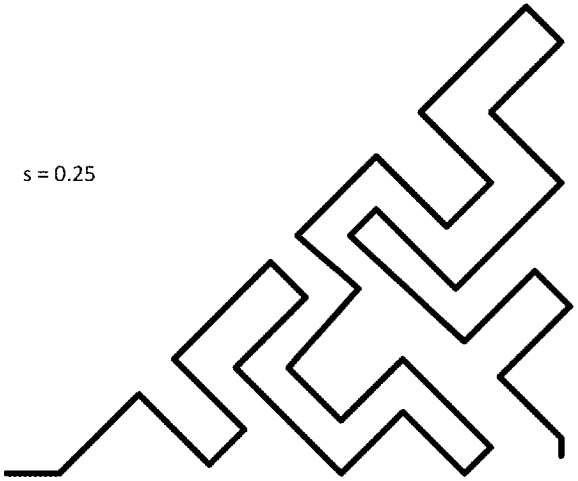
FIG. 9C s = 0.5

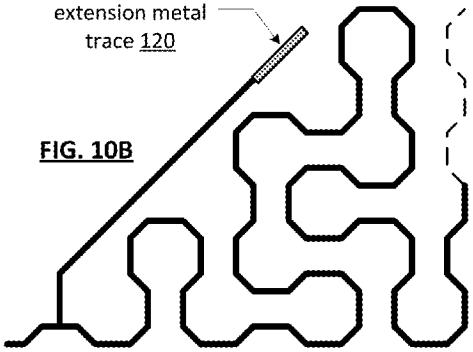
FIG. 10B
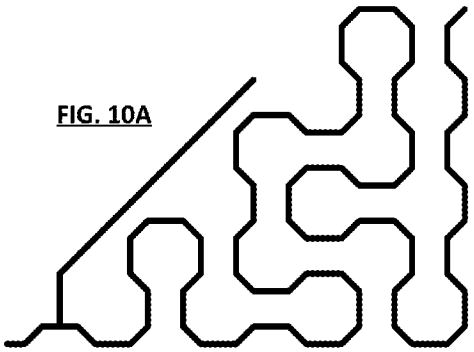
FIG. 10A
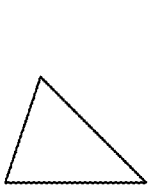
FIG. 11A
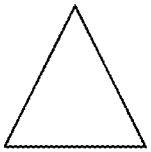
FIG. 11B
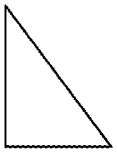
FIG. 11C
FIG. 11D
FIG. 11E
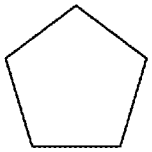
FIG. 11F
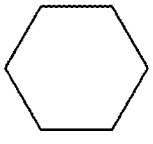
FIG. 11G
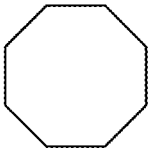
FIG. 11H antenna structure 38 - 44

THREE-DIMENSIONAL ANTENNA STRUCTURE

This patent application is claiming priority under 35 USC §119(e) to a provisionally filed patent application entitled "THREE-DIMENSIONAL ANTENNA STRUCTURES AND APPLICATIONS THEREOF," having a provisional filing date of Jan. 8, 2010, and a provisional Ser. No. 61/293,303, which is incorporated herein by reference in its entirety and made part of the present U.S. Utility Patent Application for all purposes.

This patent application is further claiming priority under 35 USC §120 as a continuation-in-part patent application of co-pending patent application entitled "ANTENNA STRUCTURES AND APPLICATIONS THEREOF," having a filing date of Dec. 18, 2009, and a Ser. No. 12/642,360, which claims priority under 35 USC §119(e) to a provisionally filed patent application entitled "ANTENNA STRUCTURE AND OPERATIONS," having a provisional filing date of Jan. 15, 2009, and a provisional Ser. No. 61/145,049, which are incorporated herein by reference in their entirety and made part of the present U.S. Utility Patent Application for all purposes.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND OF THE INVENTION

1. Technical Field of the Invention

This invention relates generally to wireless communication systems and more particularly to antennas used in such systems.

2. Description of Related Art

Communication systems are known to support wireless and wire lined communications between wireless and/or wire lined communication devices. Such communication systems range from national and/or international cellular telephone systems to the Internet to point-to-point in-home wireless networks to radio frequency identification (RFID) systems. Each type of communication system is constructed, and hence operates, in accordance with one or more communication standards. For instance, radio frequency (RF) wireless communication systems may operate in accordance with one or more standards including, but not limited to, RFID, IEEE 802.11, Bluetooth, advanced mobile phone services (AMPS), digital AMPS, global system for mobile communications (GSM), code division multiple access (CDMA), WCDMA, local multi-point distribution systems (LMDS), multi-channel-multi-point distribution systems (MMDS), LTE, WiMAX, and/or variations thereof. As another example, infrared (IR) communication systems may operate in accordance with one or more standards including, but not limited to, IrDA (Infrared Data Association).

Depending on the type of RF wireless communication system, a wireless communication device, such as a cellular telephone, two-way radio, personal digital assistant (PDA), personal computer (PC), laptop computer, home entertainment equipment, RFID reader, RFID tag, et cetera communicates directly or indirectly with other wireless communication devices. For direct communications (also known as point-to-point communications), the participating wireless communication devices tune their receivers and transmitters to the same channel or channels (e.g., one of the plurality of radio frequency (RF) carriers of the wireless communication system) and communicate over that channel(s). For indirect wireless communications, each wireless communication device communicates directly with an associated base station (e.g., for cellular services) and/or an associated access point (e.g., for an in-home or in-building wireless network) via an assigned channel. To complete a communication connection between the wireless communication devices, the associated base stations and/or associated access points communicate with each other directly, via a system controller, via the public switch telephone network, via the Internet, and/or via some other wide area network.

For each RF wireless communication device to participate in wireless communications, it includes a built-in radio transceiver (i.e., receiver and transmitter) or is coupled to an associated radio transceiver (e.g., a station for in-home and/or in-building wireless communication networks, RF modem, etc.). As is known, the receiver is coupled to the antenna and includes a low noise amplifier, one or more intermediate frequency stages, a filtering stage, and a data recovery stage. The low noise amplifier receives inbound RF signals via the antenna and amplifies then. The one or more intermediate frequency stages mix the amplified RF signals with one or more local oscillations to convert the amplified RF signal into baseband signals or intermediate frequency (IF) signals. The filtering stage filters the baseband signals or the IF signals to attenuate unwanted out of band signals to produce filtered signals. The data recovery stage recovers raw data from the filtered signals in accordance with the particular wireless communication standard.

As is also known, the transmitter includes a data modulation stage, one or more intermediate frequency stages, and a power amplifier. The data modulation stage converts raw data into baseband signals in accordance with a particular wireless communication standard. The one or more intermediate frequency stages mix the baseband signals with one or more local oscillations to produce RF signals. The power amplifier amplifies the RF signals prior to transmission via an antenna.

Since the wireless part of a wireless communication begins and ends with the antenna, a properly designed antenna structure is an important component of wireless communication devices. As is known, the antenna structure is designed to have a desired impedance (e.g., 50 Ohms) at an operating frequency, a desired bandwidth centered at the desired operating frequency, and a desired length (e.g., ¼ wavelength of the operating frequency for a monopole antenna). As is further known, the antenna structure may include a single monopole or dipole antenna, a diversity antenna structure, the same polarization, different polarization, and/or any number of other electro-magnetic properties.

One popular antenna structure for RF transceivers is a three-dimensional in-air helix antenna, which resembles an expanded spring. The in-air helix antenna provides a magnetic omni-directional monopole antenna. Other types of three-dimensional antennas include aperture antennas of a rectangular shape, horn shaped, etc.; three-dimensional dipole antennas having a conical shape, a cylinder shape, an elliptical shape, etc.; and reflector antennas having a plane reflector, a corner reflector, or a parabolic reflector. An issue with such three-dimensional antennas is that they cannot be implemented in the substantially two-dimensional space of a substrate such as an integrated circuit (IC) and/or on the printed circuit board (PCB) supporting the IC.

Two-dimensional antennas are known to include a meandering pattern or a micro strip configuration. For efficient antenna operation, the length of an antenna should be ¼ wavelength for a monopole antenna and ½ wavelength for a dipole antenna, where the wavelength ($\lambda$)=c/f, where c is the speed of light and f is frequency. For example, a ¼ wavelength antenna at 900 MHz has a total length of approximately 8.3 centimeters (i.e., $0.25*(3\times10^8$ m/s)/$(900\times10^6$ c/s)=0.25*33 cm, where m/s is meters per second and c/s is cycles per second). As another example, a ¼ wavelength antenna at 2400 MHz has a total length of approximately 3.1 cm (i.e., $0.25*(3\times10^8$ m/s)/$(2.4\times10^9$ c/s)=0.25*12.5 cm).

Regardless of whether a two-dimensional antenna is implemented on an IC and/or a PCB, the amount of area that it consumes is an issue. For example, a dipole antenna that uses Hilbert shapes operating in the 5.5 GHz frequency band requires each antenna element to be ¼ wavelength, which is 13.6 mm ["Compact 2D Hilbert Microstrip Resonators," MICROWAVE AND OPTICAL TECHNOLOGY LETTERS, Vol. 48, No. 2, February 2006]. Each antenna element consumes approximately 3.633 $mm^2$ (e.g., ½*(1.875 mm×3.875 mm)), which has a length-to-area ratio of 3.74:1 (e.g., 13.6:3.633). While this provides a relatively compact two-dimensional antenna, further reductions in consumed area are needed with little or no degradation in performance.

BRIEF SUMMARY OF THE INVENTION

The present invention is directed to apparatus and methods of operation that are further described in the following Brief Description of the Drawings, the Detailed Description of the Invention, and the claims. Other features and advantages of the present invention will become apparent from the following detailed description of the invention made with reference to the accompanying drawings.

BRIEF DESCRIPTION OF THE SEVERAL VIEWS OF THE DRAWING(S)

FIGS. 9A-9C are diagrams of embodiments of a metal trace in accordance with the present invention;

FIGS. 10A and 10B are diagrams of embodiments of a metal trace in accordance with the present invention;

FIGS. 11A-11H are diagrams of embodiments of a polygonal shape in accordance with the present invention;

DETAILED DESCRIPTION OF THE INVENTION

Figure 1:
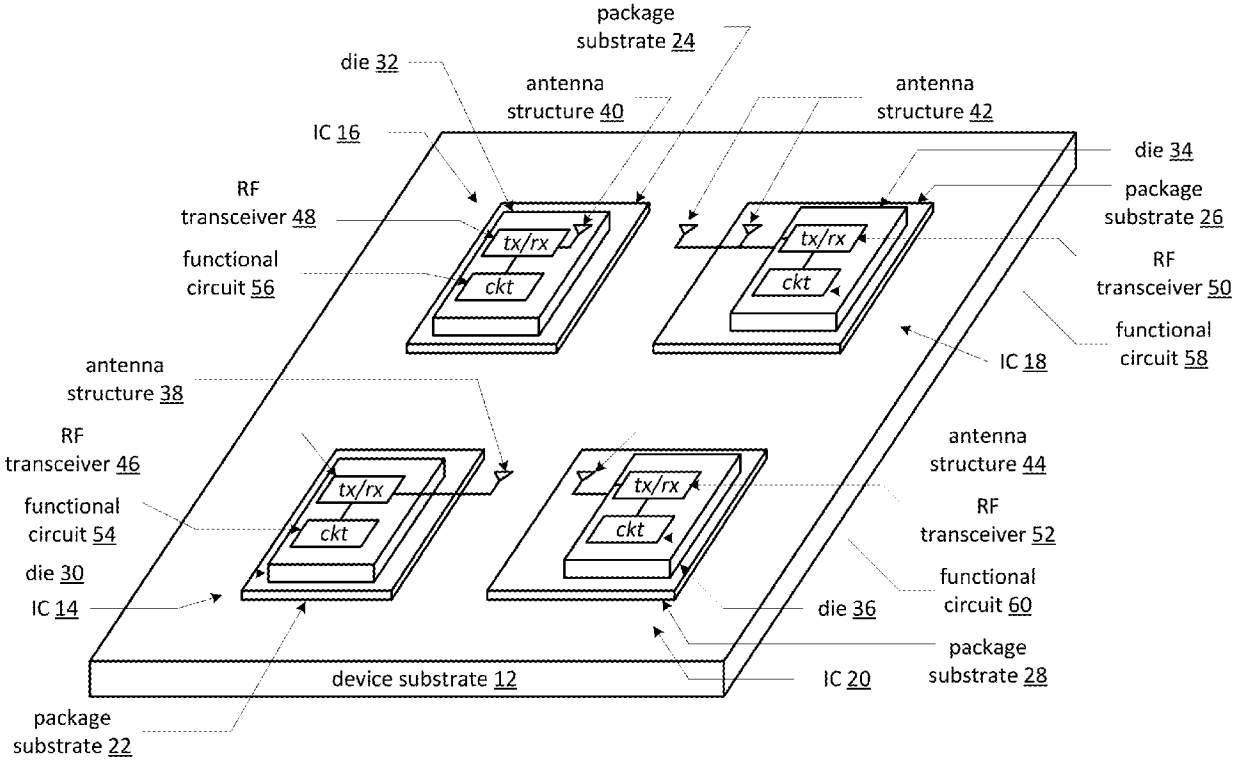
FIG. 1 is a diagram of an embodiment of a device in accordance with the present invention.

FIG. 1 is a diagram of an embodiment of a device 10 that includes a device substrate 12 and a plurality of integrated circuits (IC) 14-20. Each of the ICs 14-20 includes a package substrate 22-28 and a die 30-36. Die 30 of IC 14 includes a functional circuit 54 and a radio frequency (RF) transceiver 46 coupled to an antenna structure 38 on the substrate 12. Die 32 of IC 16 includes an antenna structure 40, an RF transceiver 48, and a functional circuit 56. Die 34 of IC 18 includes an RF transceiver 50 and a function circuit 58 and the package substrate 26 of IC 18 and the substrate 12 supports an antenna structure 42 that is coupled to the RF transceiver 52. Die 36 of IC 20 includes an RF transceiver 52 and a function circuit 60 and the package substrate 28 of IC 20 supports an antenna structure 44 coupled to the RF transceiver 52.

The device 10 may be any type of electronic equipment that includes integrated circuits. For example, but far from an exhaustive list, the device 10 may be a personal computer, a laptop computer, a hand held computer, a wireless local area network (WLAN) access point, a WLAN station, a cellular telephone, an audio entertainment device, a video entertainment device, a video game control and/or console, a radio, a cordless telephone, a cable set top box, a satellite receiver, network infrastructure equipment, a cellular telephone base station, and Bluetooth head set. Accordingly, the functional circuit 54-60 may include one or more of a WLAN baseband processing module, a WLAN RF transceiver, a cellular voice baseband processing module, a cellular voice RF transceiver, a cellular data baseband processing module, a cellular data RF transceiver, a local infrastructure communication (LIC) baseband processing module, a gateway processing module, a router processing module, a game controller circuit, a game console circuit, a microprocessor, a microcontroller, and memory.

In one embodiment, the dies 30-36 may be fabricated using complimentary metal oxide (CMOS) technology and the package substrate may be a printed circuit board (PCB). In other embodiments, the dies 30-36 may be fabricated using Gallium-Arsenide technology, Silicon-Germanium technology, bi-polar, bi-CMOS, and/or any other type of IC fabrication technique. In such embodiments, the package substrate 22-28 may be a printed circuit board (PCB), a fiberglass board, a plastic board, and/or some other non-conductive material board. Note that if the antenna structure is on the die, the package substrate may simply function as a supporting structure for the die and contain little or no traces.

In an embodiment, the RF transceivers 46-52 provide local wireless communication (e.g., IC to IC communication) and/or remote wireless communications (e.g., to/from the device to another device). In this embodiment, when a functional circuit of one IC has information (e.g., data, operational instructions, files, etc.) to communication to another functional circuit of another IC or to another device, the RF transceiver of the first IC conveys the information via a wireless path to the RF transceiver of the second IC or to the other device. In this manner, some to all of the IC-to-IC communications may be done wirelessly.

In one embodiment, a baseband processing module of the first IC converts outbound data (e.g., data, operational instructions, files, etc.) into an outbound symbol stream. The conversion of outbound data into an outbound symbol stream may be done in accordance with one or more data modulation schemes, such as amplitude modulation (AM), frequency modulation (FM), phase modulation (PM), amplitude shift keying (ASK), phase shift keying (PSK), quadrature PSK (QPSK), 8-PSK, frequency shift keying (FSK), minimum shift keying (MSK), Gaussian MSK (GMSK), quadrature amplitude modulation (QAM), a combination thereof, and/or alterations thereof. For example, the conversion of the outbound data into the outbound system stream may include one or more of scrambling, encoding, puncturing, interleaving, constellation mapping, modulation, frequency to time domain conversion, space-time block encoding, space-frequency block encoding, beamforming, and digital baseband to IF conversion.

The RF transceiver of the first IC converts the outbound symbol stream into an outbound RF signal. The antenna structure of the first IC is coupled to the RF transceiver and transmits the outbound RF signal, which has a carrier frequency within a frequency band (e.g., 900 MHz, 1800 MHz, 1900 MHz, 2.4 GHz, 5.5. GHz, 55 GHz to 64 GHz, etc.). Accordingly, the antenna structure includes electromagnetic properties to operate within the frequency band. For example, the length of the antenna structure may be ¼ or ½ wavelength, have a desired bandwidth, have a desired impedance, have a desired gain, etc.

For a local wireless communication, the antenna structure of the second IC receives the RF signal as an inbound RF signal and provides it to the RF transceiver of the second IC. The RF transceiver converts the inbound RF signal into an inbound symbol stream and provides the inbound symbol stream to a baseband processing module of the second IC. The baseband processing module of the second IC converts the inbound symbol stream into inbound data in accordance with one or more data modulation schemes, such as amplitude modulation (AM), frequency modulation (FM), phase modulation (PM), amplitude shift keying (ASK), phase shift keying (PSK), quadrature PSK (QSK), 8-PSK, frequency shift keying (FSK), minimum shift keying (MSK), Gaussian MSK (GMSK), quadrature amplitude modulation (QAM), a combination thereof, and/or alterations thereof. For example, the conversion of the inbound system stream into the inbound data may include one or more of descrambling, decoding, depuncturing, deinterleaving, constellation demapping, demodulation, time to frequency domain conversion, space-time block decoding, space-frequency block decoding, debeamforming, and IF to digital baseband conversion. Note that the baseband processing modules of the first and second ICs may be on same die as RF transceivers or on a different die within the respective IC.

In other embodiments, each IC 14-20 may include a plurality of RF transceivers and antenna structures on-die, on-package substrate, and/or on the substrate 12 to support multiple simultaneous RF communications using one or more of frequency offset, phase offset, wave-guides (e.g., use waveguides to contain a majority of the RF energy), frequency reuse patterns, frequency division multiplexing, time division multiplexing, null-peak multiple path fading (e.g., ICs in nulls to attenuate signal strength and ICs in peaks to accentuate signal strength), frequency hopping, spread spectrum, space-time offsets, and space-frequency offsets. Note that the device 10 is shown to only include four ICs 14-20 for ease of illustrate, but may include more or less that four ICs in practical implementations.

Figure 2:
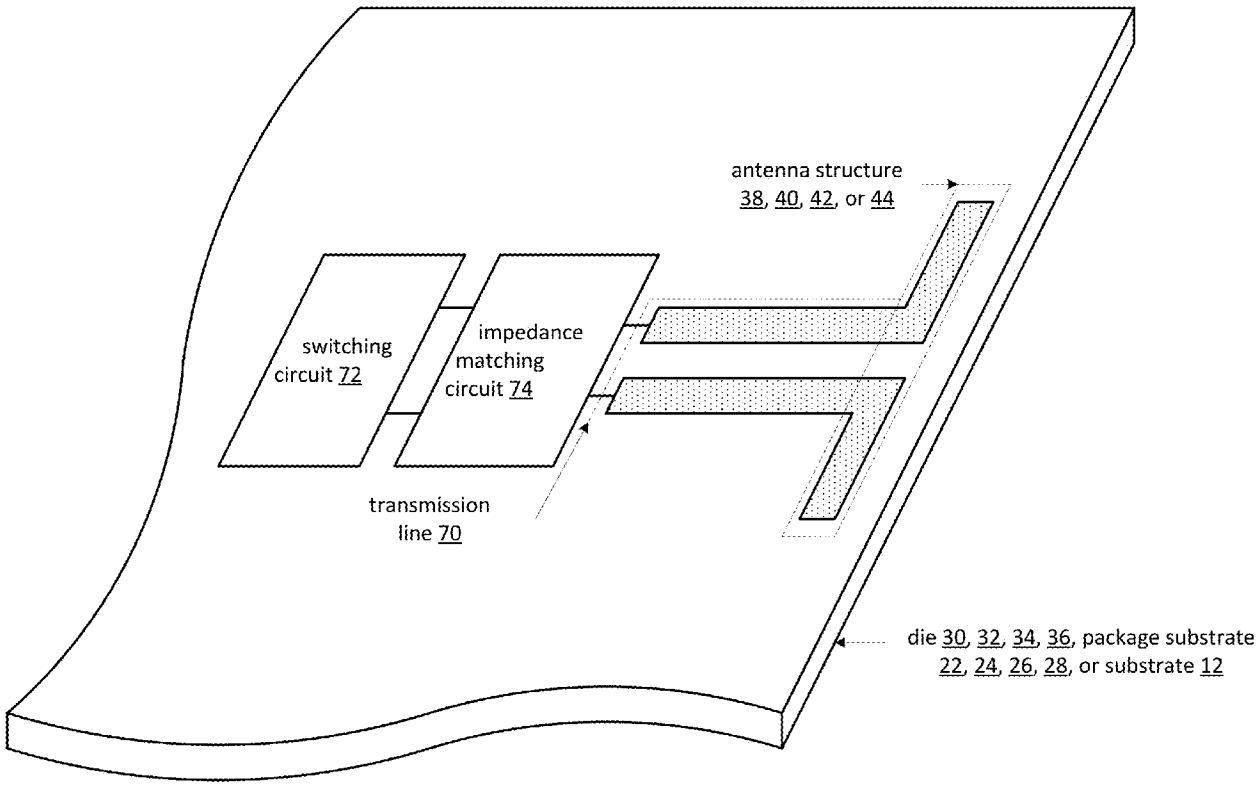
FIG. 2 is a diagram of an embodiment of an antenna apparatus in accordance with the present invention.

FIG. 2 is a diagram of an embodiment of an antenna structure 38-44 on a die 30-36, a package substrate 22-28, and/or the substrate 12. The antenna structure 38-44 is coupled to a transmission line 70, which may be coupled to an impedance matching circuit 74 and a switching circuit 72. The antenna structure 38-44 may be one or more metal traces on the die 30-36, the package substrate 22-28, and/or the substrate 12 to provide a half-wavelength dipole antenna, a quarter-wavelength monopole antenna, an antenna array, a multiple input multiple output (MIMO) antenna, and/or a microstrip patch antenna.

The transmission line 70, which may be a pair of microstrip lines on the die 30-36, the package substrate 22-28, and/or on the device substrate 12 (individually, collectively or in combination may provide the substrate for the antenna apparatus), is electrically coupled to the antenna structure 38-44 and electromagnetically coupled to the impedance matching circuit 74 by first and second conductors. In one embodiment, the electromagnetic coupling of the first conductor to a first line of the transmission line 70 produces a first transformer and the electromagnetic coupling of the second conductor to a second line of the transmission line 70 produces a second transformer.

The impedance matching circuit 74, which may include one or more of an adjustable inductor circuit, an adjustable capacitor circuit, an adjustable resistor circuit, an inductor, a capacitor, and a resistor, in combination with the transmission line 70 and the first and second transformers establish the impedance for matching that of the antenna structure 38-44.

The switching circuit 72 includes one or more switches, transistors, tri-state buffers, and tri-state drivers, to couple the impedance matching circuit 74 to the RF transceiver 46-52 (from FIG. 2.) In one embodiment, the switching circuit 72 receives a coupling signal from the RF transceiver 46-52 from FIG. 2, a control module, and/or a baseband processing module, wherein the coupling signal indicates whether the switching circuit 72 is open (i.e., the impedance matching circuit 74 is not coupled to the RF transceiver 46-52 from FIG. 2) or closed (i.e., the impedance matching circuit 74 is coupled to the RF transceiver 46-52 from FIG. 2).

Figure 3:
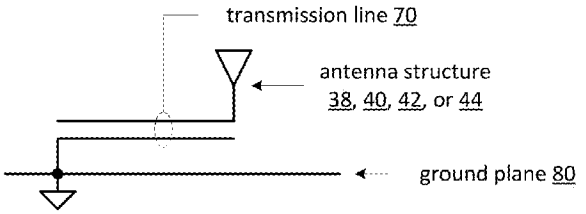
FIG. 3 is a schematic block diagram of an embodiment of antenna in accordance with the present invention.

FIG. 3 is a schematic diagram of an antenna structure 38-44 coupled to the transmission line 70 and a ground plane 80. The antenna structure 38-44 may be a half-wavelength dipole antenna or a quarter-wavelength monopole antenna that includes a trace having a modified Polya curve shape that is confined to a triangular shape. The transmission line 70 includes a first line and a second line, which are substantially parallel. In one embodiment, at least the first line of the transmission line 70 is electrically coupled to the antenna structure 38-44.

The ground plane 80 has a surface area larger than the surface area of the antenna structure 38-44. The ground plane 80, from a first axial perspective, is substantially parallel to the antenna structure 38-44 and, from a second axial perspective, is substantially co-located to the antenna structure 38-44.

Figure 4:
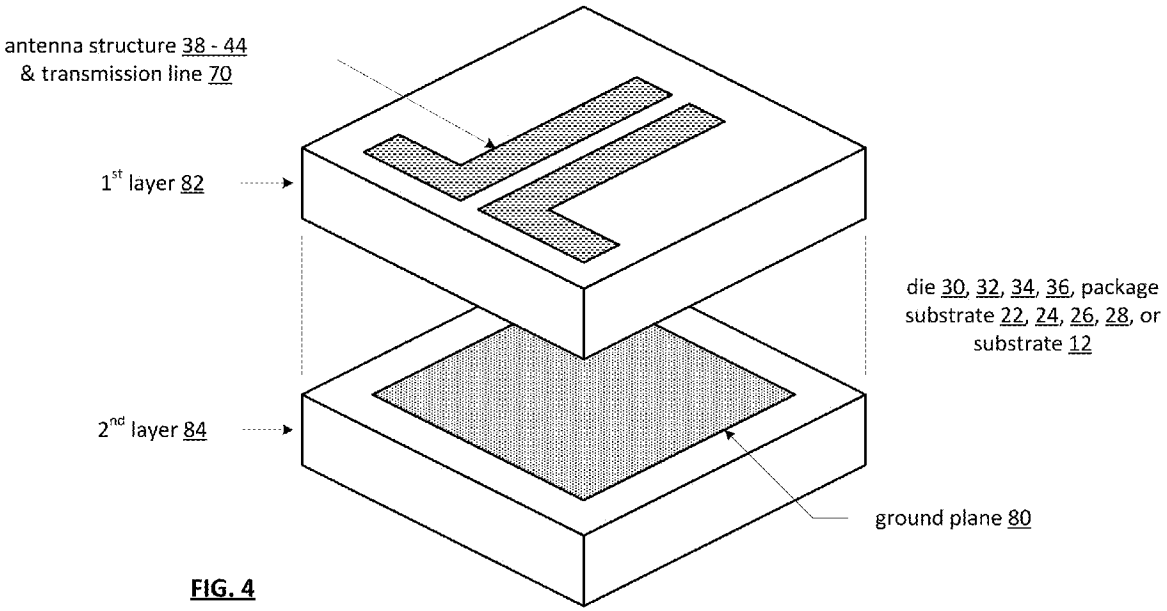
FIG. 4 is a diagram of another embodiment of an antenna apparatus in accordance with the present invention.

FIG. 4 is a diagram of an embodiment of an antenna structure 38-44 on a die 30-36, a package substrate 22-28, and/or the device substrate 12. The antenna structure 38-44 includes one or more antenna elements, the antenna ground plane 80, and the transmission line 70. In this embodiment, the one or more antenna elements and the transmission line 70 are on a first layer 82 of the die 30-36, the package substrate 22-28, and/or the device substrate 12, and the ground plane 80 is on a second layer 84 of the die 30-36, the package substrate 22-28, and/or the device substrate 12.

Figure 5:
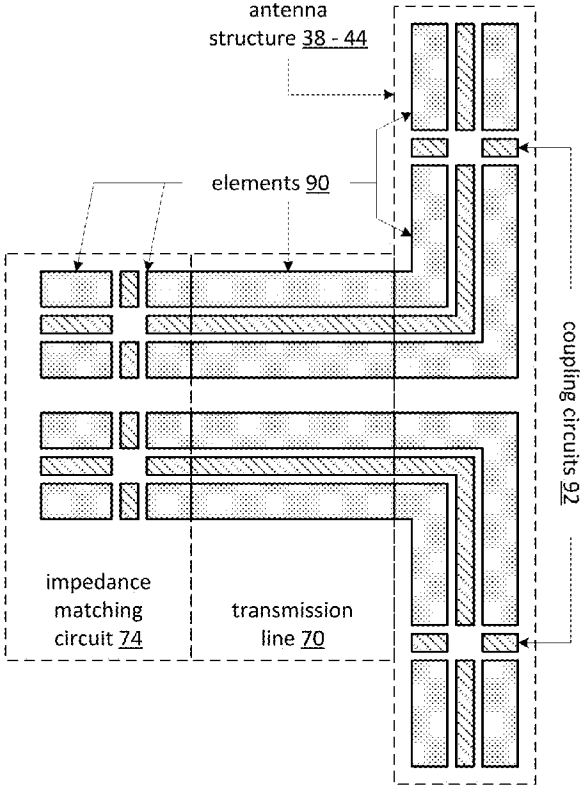
FIG. 5 is a diagram of another embodiment of an antenna apparatus in accordance with the present invention.

FIG. 5 is a diagram of an embodiment of an antenna structure 38-44 coupled to the transmission line 70, which is coupled to the impedance matching circuit 74. In this illustration, the antenna structure 38-44, the transmission line 70, and the impedance matching circuit 74 includes a plurality of elements 90 and coupling circuits 92. The coupling circuits 92 allow the elements 90 to be configured to provide antenna structure 38-44 with desired antenna properties. For example, the antenna structure 38-44 may have a different desired effective length, a different desired bandwidth, a different desired impedance, a different desired quality factor, and/or a different desired frequency band.

As a specific example, the bandwidth of an antenna having a length of ½ wavelength or less is primarily dictated by the antenna's quality factor (Q), which may be mathematically expressed as shown in Eq. 1 where $v_0$ is the resonant frequency, 2δv is the difference in frequency between the two half-power points (i.e., the bandwidth).

$$\frac{v_0}{2\partial v} = \frac{1}{Q} \text{ (where is equation 1 ?)} \qquad \text{Equation 1}$$

Equation 2 provides a basic quality factor equation for the antenna structure, where R is the resistance of the antenna structure, L is the inductance of the antenna structure, and C is the capacitor of the antenna structure.

$$Q = \frac{1}{R} * \sqrt{\frac{L}{C}} \text{ (where is equation 2 ?)} \qquad \text{Equation 2}$$

As such, by adjusting the resistance, inductance, and/or capacitance of an antenna structure, the bandwidth can be controlled. For instance, the smaller the quality factor, the narrower the bandwidth. Note that the capacitance is primarily established by the length of, and the distance between, the lines of the transmission line 70, the distance between the elements of the antenna 90, and any added capacitance to the antenna structure. Further note that the lines of the transmission line 70 and those of the antenna structure 38-44 may be on the same layer of an IC, package substrate, and/or the device substrate 12 and/or on different layers.

Figure 6:
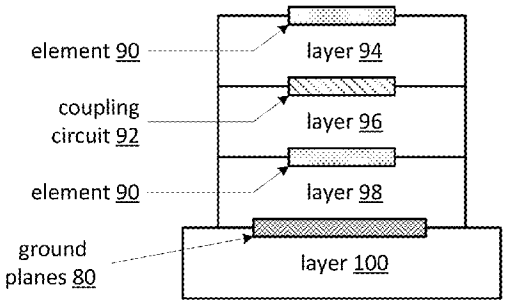
FIG. 6 is a diagram of another embodiment of an antenna apparatus in accordance with the present invention.

FIG. 6 is a diagram of an embodiment of an antenna structure 38-44 that includes the elements 90 on layers 94 and 98 of the substrate (e.g., the die, the package substrate, and/or the device substrate) and the coupling circuits 92 on layer 96. If a ground plane 80 is included, it may be on another layer 100 of the substrate.

In this embodiment, with the elements 90 on different layers, the electromagnetic coupling between them via the coupling circuits 92 is different than when the elements are on the same layer as shown in FIG. 5. Accordingly, a different desired effective length, a different desired bandwidth, a different desired impedance, a different desired quality factor, and/or a different desired frequency band may be obtained.

In an embodiment of this illustration, the adjustable ground plane 80 may include a plurality of ground planes and a ground plane selection circuit. The plurality of ground planes is on one or more layers of the substrate.

In an embodiment of this illustration, the adjustable ground plane 572 (80?) includes a plurality of ground plane elements and a ground plane coupling circuit. The ground plane coupling circuit is operable to couple at least one of the plurality of ground plane elements into the ground plane 80 in accordance with a ground plane characteristic signal, which may be provided by one or more of the functional circuits.

Figure 7:
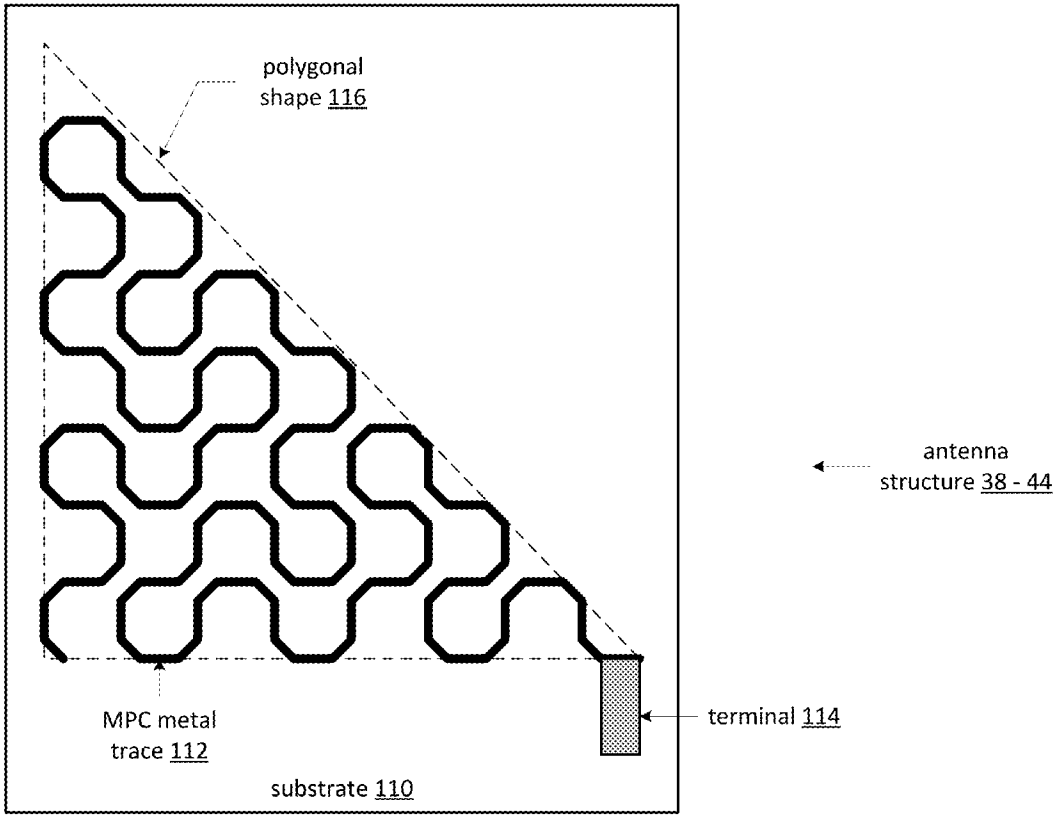
FIG. 7 is a diagram of an embodiment of an antenna structure in accordance with the present invention.

FIG. 7 is a diagram of an embodiment of an antenna structure 38-44 that includes a modified Polya curve (MPC) metal trace 112 and a terminal 114 coupled thereto. The MPC metal trace 112 is confined to a polygonal shape 116 and has an order (e.g., n=>2—examples are shown in FIGS. 8*a*-8*e*), line width (e.g., trace width), and/or a shaping factor (e.g., s<1—examples are show in FIGS. 9*a*-9*c*). The antenna structure is supported by a substrate 110 (which may be an IC die, a IC package substrate, and/or a device substrate).

The MPC metal trace 112 may be configured to provide one or more of a variety of antenna configurations. For example, the MPC metal trace 112 may have a length of ¼ wavelength to provide a monopole antenna. As another example, the MPC metal trace 112 may be configured to provide a dipole antenna. In this example, the MPC metal trace 112 would include two sections, each ¼ wavelength in length. As yet another example, the MPC metal trace 112 may be configure to provide a microstrip patch antenna.

Figure 8A:
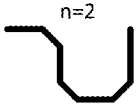
FIGS. 8A-8E are diagrams of embodiments of a metal trace in accordance with the present invention.
Figure 8B:
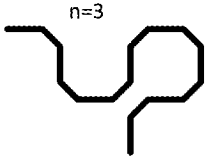
Figure 8C:
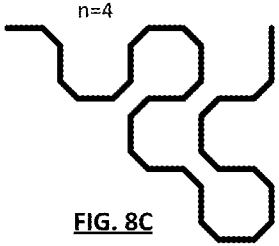
Figure 8D:
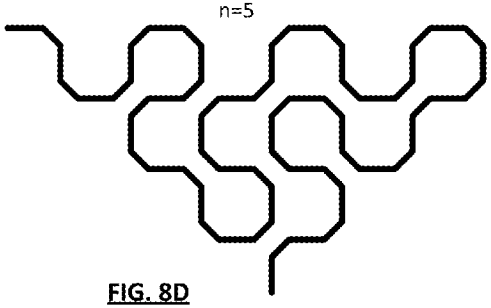
Figure 8E:
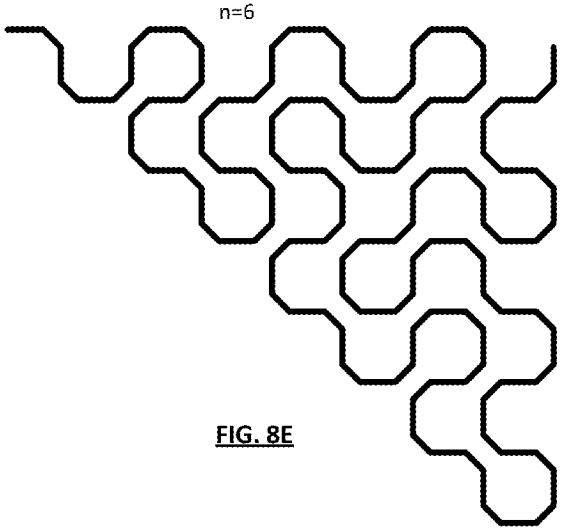

FIGS. 8A-8E are diagrams of embodiments of an MPC (modified Polya curve) metal trace having a constant width (w) and shaping factor (s) and varying order (n). In particular, FIG. 8A illustrates a MPC metal trace having a second order; FIG. 8B illustrates a MPC metal trace having a third order; FIG. 8C illustrates a MPC metal trace having a fourth order; FIG. 8D illustrates a MPC metal trace having a fifth order; and FIG. 8E illustrates a MPC metal trace having a sixth order. Note that higher order MPC metal traces may be used within the polygonal shape to provide the antenna structure.

FIGS. 9A-9C are diagrams of embodiments of an MPC (modified Polya curve) metal trace having a constant width (w) and order (n) and a varying shaping factor (s). In particular, FIG. 9A illustrates a MPC metal trace having a 0.15 shaping factor; FIG. 9B illustrates a MPC metal trace having a 0.25 shaping factor; and FIG. 9C illustrates a MPC metal trace having a 0.5 shaping factor. Note that MPC metal trace may have other shaping factors to provide the antenna structure.

FIGS. 10A and 10B are diagrams of embodiments of an MPC (modified Polya curve) metal trace. In FIG. 10A, the MPC metal trace is confined in an orthogonal triangle shape and includes two elements: the shorter angular straight line and the curved line. In this implementation, the antenna structure is operable in two or more frequency bands. For example, the antenna structure may be operable in the 2.4 GHz frequency band and the 5.5 GHz frequency band.

FIG. 10B illustrates an optimization of the antenna structure of FIG. 10A. In this diagram, the straight line trace includes an extension metal trace 120 and the curved line is shortened. In particular, the extension trace 120 and/or the shortening of the curved trace tune the properties of the antenna structure (e.g., frequency band, bandwidth, gain, etc.).

FIGS. 11A-11H are diagrams of embodiments of polygonal shapes in which the modified Polya curve (MPC) trace may be confined. In particular, FIG. 11A illustrates an Isosceles triangle; FIG. 11B illustrates an equilateral triangle; FIG. 11C illustrates an orthogonal triangle; FIG. 11D illustrates an arbitrary triangle; FIG. 11E illustrates a rectangle; FIG. 11F illustrates a pentagon; FIG. 11G illustrates a hexagon; and FIG. 11H illustrates an octagon. Note that other geometric shapes may be used to confine the MPC metal trace (e.g., a circle, an ellipse, etc.).

Figure 12:
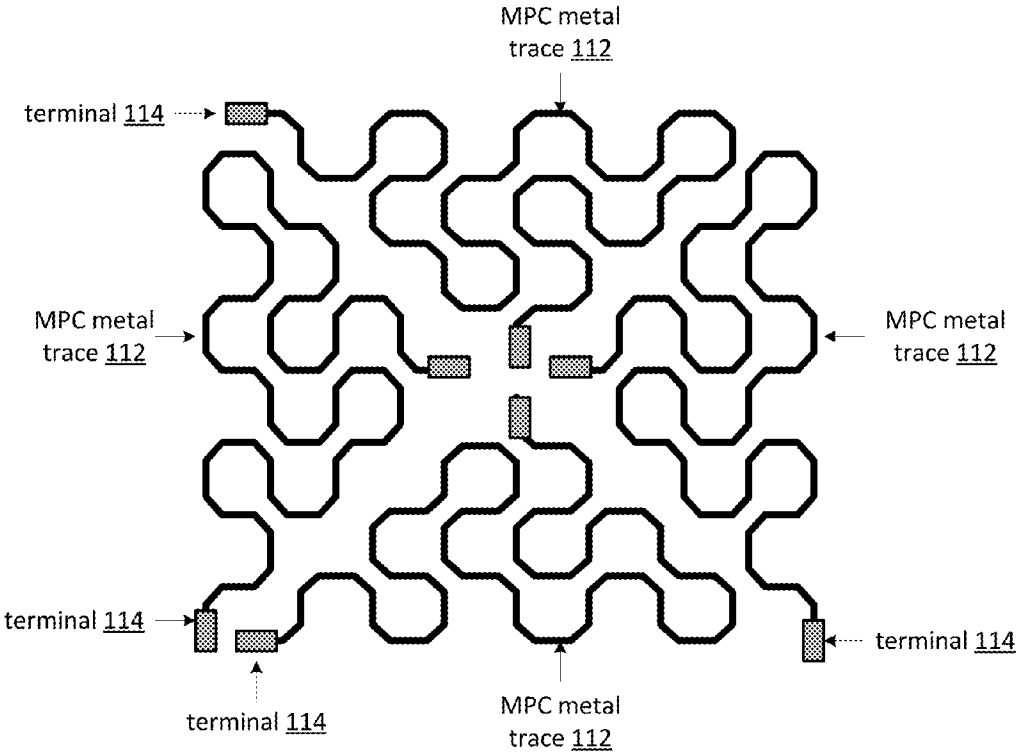
FIG. 12 is a diagram of another embodiment of an antenna structure in accordance with the present invention.

FIG. 12 is a diagram of another embodiment of an antenna structure 38-44 that includes a plurality of metal traces 112 and a plurality of terminals 114. The plurality of metal traces 112 are confined within the polygonal shape (a rectangle in this example, but could be a triangle, a pentagon, a hexagon, an octagon, etc.) and each of the metal traces 112 has the modified Polya curve shape. The plurality of terminals 114 are coupled to the plurality of metal traces 112.

In this embodiment, the plurality of metal traces 112 may be coupled to form an antenna array; may be coupled to form a multiple input multiple output (MIMO) antenna; may be coupled to form a microstrip patch antenna; may be coupled to form a dipole antenna; or may be coupled to form a monopole antenna.

Figure 13:
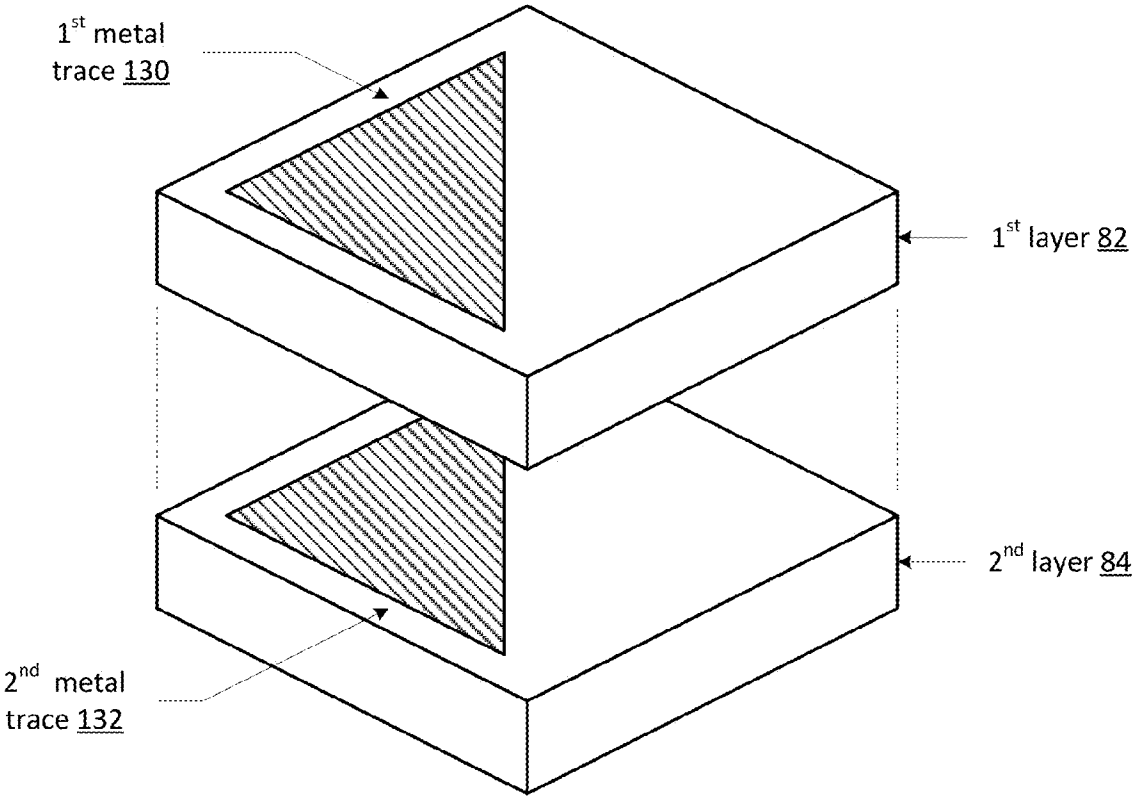
FIG. 13 is a diagram of another embodiment of an antenna apparatus in accordance with the present invention.

FIG. 13 is a diagram of another embodiment of an antenna apparatus that includes a substrate (e.g., a die, an IC package substrate, and/or a device substrate) and an antenna structure, which includes a first metal trace 130 and a second metal trance 132. The substrate includes a plurality of layers 82-84. Note that the layers may be of the same substrate element (e.g., the die, the IC package substrate, or the device substrate) or of different substrate elements (e.g., one or more layers of the IC package substrate, one or more layers from the device substrate, one or more layers of the die).

The first metal trace 130 has a first modified Polya curve shape (e.g., has a first order value, a first shaping factor value, and a first line width or trace width value) that is confined in a first polygonal shape (e.g., a triangular shape, a rectangle, a pentagon, hexagon, an octagon, etc.). As shown, the first metal trace 130 is on a first layer 82 of the substrate. While not specifically shown in this illustration, a first terminal is coupled to the first metal trace. Examples of such a configuration are provided in previous figures.

The second metal trace 132 has a second modified Polya curve shape (e.g., has a second order value, a second shaping factor value, and a second line width or trace width value) that is confined in a second polygonal shape (e.g., a triangular shape, a rectangle, a pentagon, hexagon, an octagon, etc.). As is also shown, the second metal trace 132 is on the second layer 84 of the substrate. Note that the first and second modified Polya curves may be the same (e.g., have the same order, shaping factor, and trace width) or different modified Polya curves (e.g., have one or differences in the order, shaping factor, and/or trace width). Further note that a second terminal is coupled to the second metal trace 132.

In an embodiment, the first and second metals trace 130, 132 may be configured to provide a microstrip patch antenna; a dipole antenna; or a monopole antenna. In another embodiment, the first metal trace 130 may be configured to provide a first microstrip patch antenna and the second metal trace 132 may be configured to provide a second microstrip patch antenna. In another embodiment, the first metal trace 130 may be configured to provide a dipole antenna and the second metal trace 132 may be configured to provide a second dipole antenna. In another embodiment, the first metal trace 130 may be configured to provide a first monopole antenna and the second metal trace 132 configured to provide a second monopole antenna. In one or more of the embodiments, the first and/or second metal trace 130, 132 may include an extension metal trace to tune antenna properties of the antenna structure.

Figure 14:
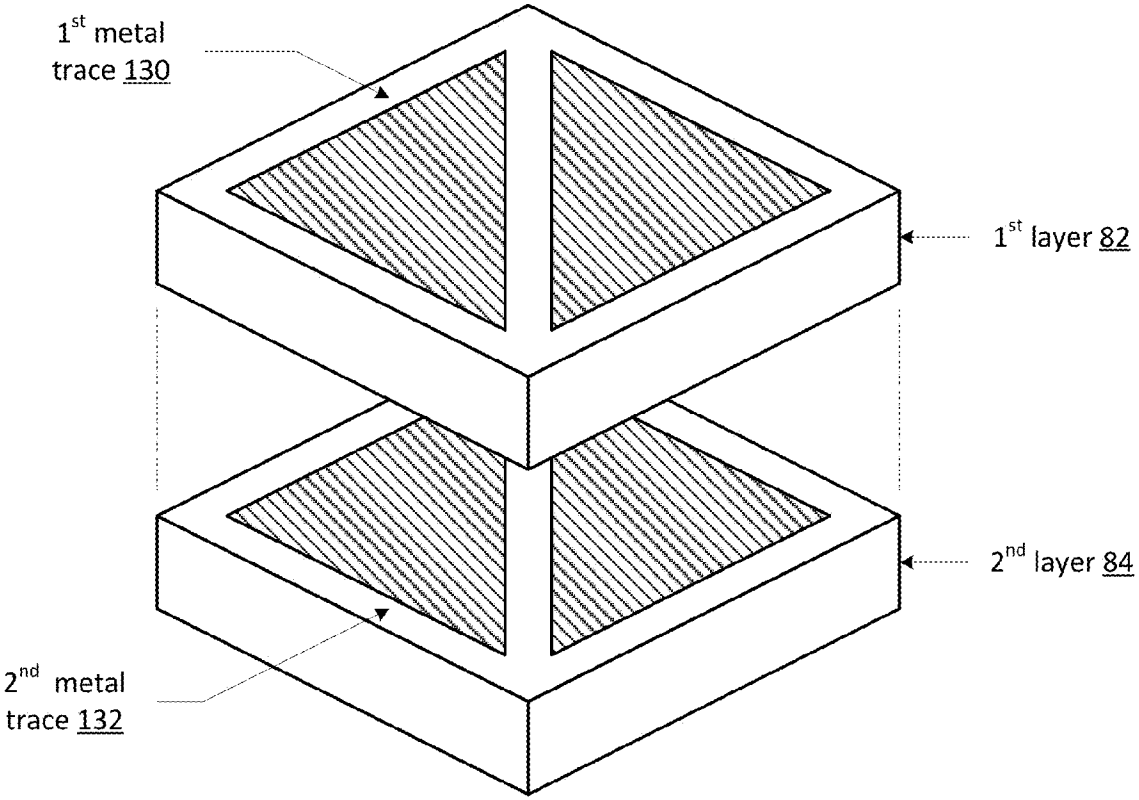
FIG. 14 is a diagram of another embodiment of an antenna apparatus in accordance with the present invention.

FIG. 14 is a diagram of further embodiment of the antenna apparatus of FIG. 13. In this embodiment, the first and/or second metal traces 130, 132 includes a plurality of metal trace segments confined within at least one of the first and second polygonal shapes. Each of the plurality of metal trace segments has at least one of the first and second modified Polya curve shapes and is coupled to a corresponding one of a plurality of terminals.

In an embodiment, the plurality of metal trace segments of the first and/or second metal traces 130, 132 may be coupled to form one or more antenna arrays. In another embodiment, the plurality of metal trace segments of the first and/or second metal traces 130, 132 may be coupled to form one or more multiple input multiple output (MIMO) antennas. In another embodiment, the plurality of metal trace segments of the first and/or second metal traces 130, 132 may be coupled to form one or more microstrip patch antennas. In another embodiment, the plurality of metal trace segments of the first and/or second metal traces 130, 132 may be coupled to form one or more dipole antennas. In another embodiment, the plurality of metal trace segments of the first and/or second metal traces 130, 132 may be coupled to form one or more monopole antennas.

Figure 15:
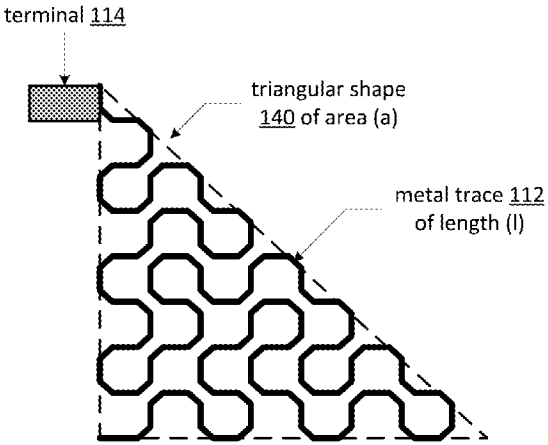
FIG. 15 is a diagram of another embodiment of an antenna apparatus in accordance with the present invention.

FIG. 15 is a diagram of another embodiment of an antenna apparatus that includes a metal trace 112 of length (l) having a modified Polya curve shape that is confined in a triangular shape 140 of area (a). The length of the metal trace 112 is approximately 4 to 7 times the area of the triangular shape (e.g., Isosceles, equilateral, orthogonal, or arbitrary). In other words, the metal trace has a length-to-area ratio of approximately 4-to-1 to 7-to-1. In comparison to the Hilbert shaped antennas, which has a length-to-area ratio of 3.74:1, the antenna apparatus including a modified Polya curve shape is at least 30% smaller in area. Note that the metal trace 112 is coupled to a terminal 114.

The properties of the antenna apparatus (e.g., center frequency, bandwidth, gain, quality factor, etc.) may be tuned by having an extension metal trace coupled to the metal trace 112. The properties may be further tuned based on the order, the line width, and/or the shaping factor of the modified Polya curve.

In another embodiment, the antenna apparatus includes a plurality of metal traces 112; each having the modified Polya curve shape that is confined in the triangular shape and a length-to-area ratio that is approximately in the range of 4-to-1 to 7-to-1. In this embodiment, the plurality of metal traces are arranged to form a polygonal shape (e.g., a rectangle, a pentagon, a hexagon, an octagon, etc.) to form an antenna array, a MIMO antenna, a microstrip patch antenna, a monopole antenna, or a dipole antenna. Note that the plurality of metal traces 112 is coupled to a plurality of terminals 114.

Figure 16:
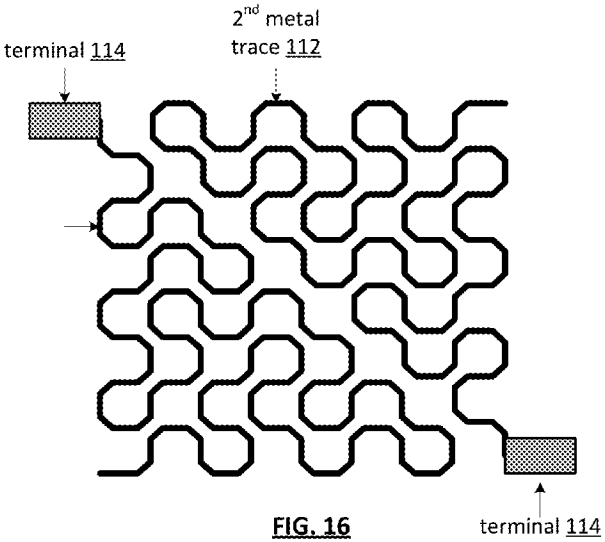
FIG. 16 is a diagram of another embodiment of an antenna apparatus in accordance with the present invention.
Figure 17:
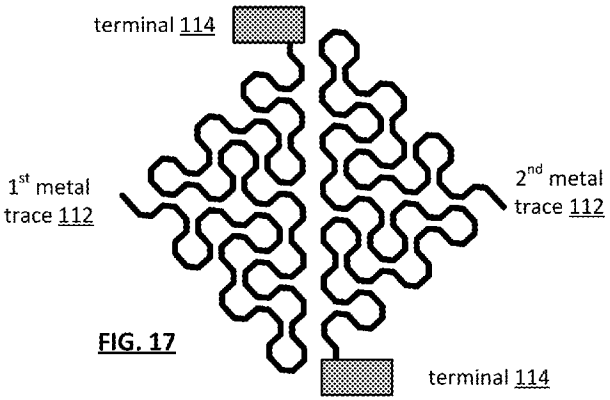
FIG. 17 is a diagram of an embodiment of a three-dimensional antenna apparatus in accordance with the present invention.

FIGS. 16 and 17 are diagrams of dipole antennas having a first and second metal traces 112, each having a modified Polya curve shape confined in a triangular shape and a length-to-area ratio of approximately 4-to-1 to 7-to-1. The first metal trace 112 is juxtaposed to the second metal trace 112 and each is coupled to a terminal 114. In FIG. 16, the metal traces are confined in an orthogonal triangle and in FIG. 17 the metal traces 112 are confined in an equilateral triangle.

Figure 18:
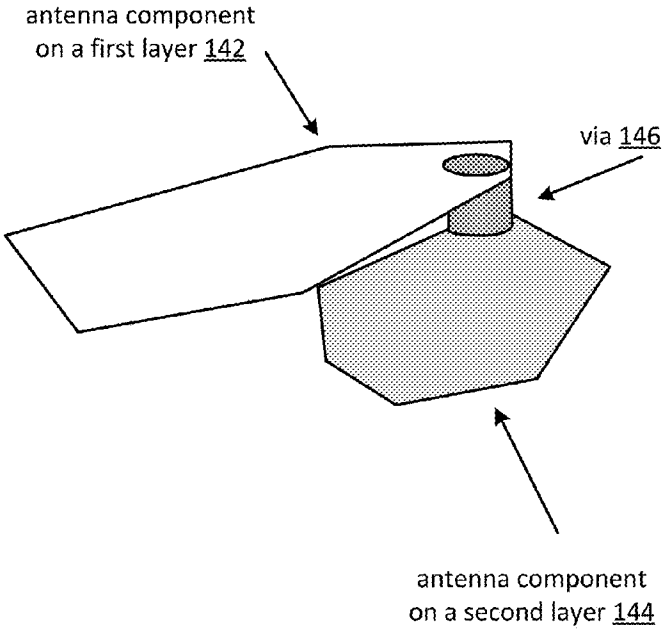
FIG. 18 is a diagram of another embodiment of a three-dimensional antenna apparatus in accordance with the present invention.

FIG. 18 is a diagram of an embodiment of a three-dimensional antenna apparatus that includes a first antenna component 142, a second antenna component 144, and at least one via 146. The first antenna component 142, which may have a first pattern and an arbitrary geometric shape as may be shown herein or other shapes, is on a first layer of an integrated circuit (IC), of an IC package substrate, and/or of a printed circuit board (PCB). The second antenna component 144, which may have a second pattern and an arbitrary geometric shape that are the same or different than those of the first antenna component 142, is on a second layer of the IC, of the IC substrate, and/or of the PCB. For example, the first and/or second pattern may be a modified Polya curve as shown in one or more of the preceding figures.

The antenna apparatus may further include more antenna components on additional layers and may include further vias 146. For example, a third antenna component, which may have a third pattern of an arbitrary geometric shape that are the same or different as those of the first and/or second antenna components, is on a third layer of the IC, of the IC substrate, and/or of the PCB. The first antenna component 142 is coupled to the second antenna element using one or more vias 146 and the second antenna component 144 may be coupled to the third antenna component using one or more vias 146. The combined length of the antenna structure (e.g., a sum of the individual lengths of the first and second antenna components 142, 144, and the third if included) at least partially determines the operating characteristics (e.g., frequency, bandwidth, quality factor, impedance, etc.) of the antenna structure. Such an antenna structure provides a small footprint antenna that may be used in numerous RF and/or MMW communication devices.

Figure 19:
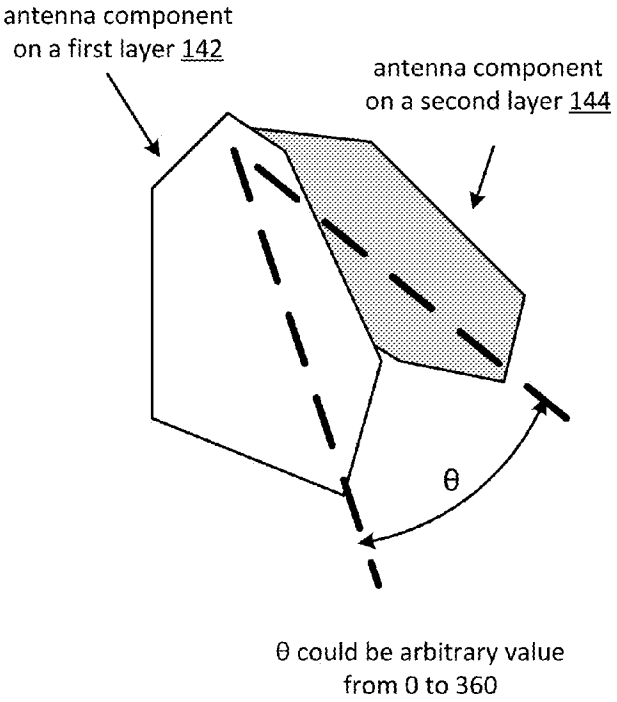
FIG. 19 is a diagram of another embodiment of a three-dimensional antenna apparatus in accordance with the present invention.

FIG. 19 is a diagram of another embodiment of a three-dimensional antenna apparatus that includes the first antenna component 142, the second antenna component 144, and the at least one via. In this illustration, the angle of overlap (θ) may range from 0 to 360 degrees, which may also contribute to the operating characteristics of the antenna (e.g., gain, radiation pattern, etc.). As such, from a radial layer perspective, the first antenna component 142 may completely overlap the second antenna component 144, may partially overlap the second antenna component 144, or may minimally overlap the second antenna component 144.

Figure 20:
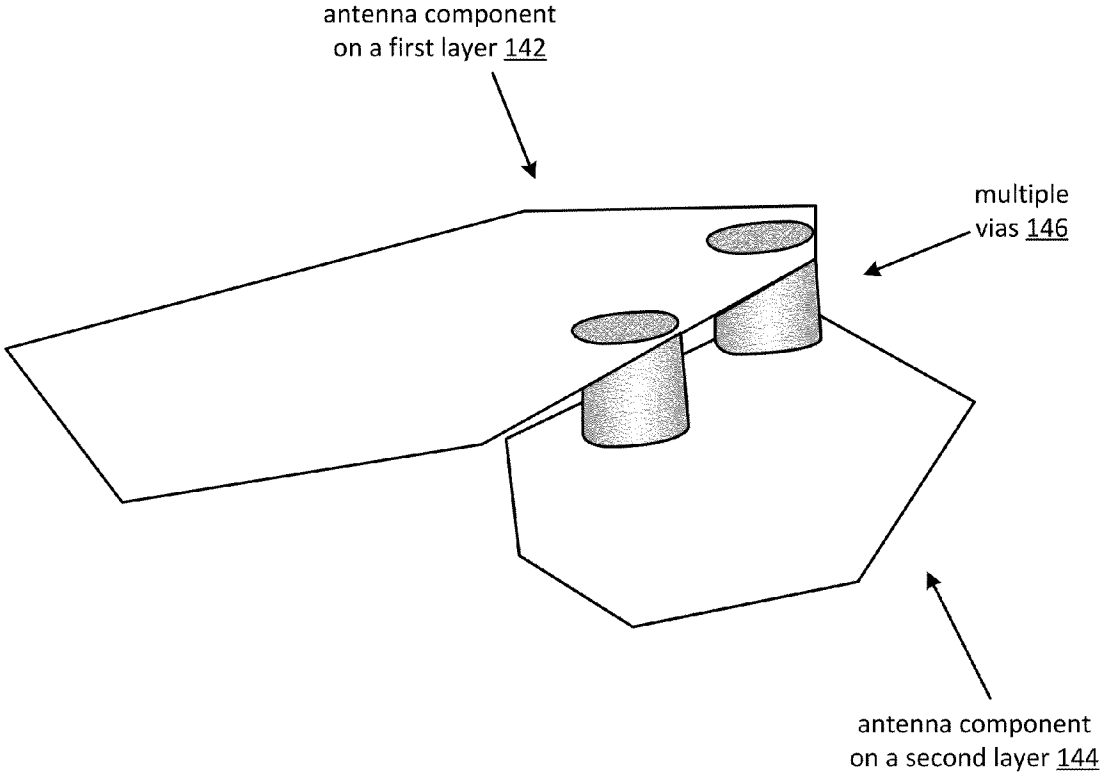
FIG. 20 is a diagram of another embodiment of a three-dimensional antenna apparatus in accordance with the present invention.

FIG. 20 is a diagram of another embodiment of a three-dimensional antenna apparatus that includes the first antenna component 142, the second antenna component 144, and the at least one via 146. In this illustration, the first antenna component 142 is coupled to the second antenna component 144 by multiple vias 146. Note that the number of vias 146 may vary from 1 to dozens as may be desired to establish the electrical connection between the first and second antenna components 142,144.

Figure 21:
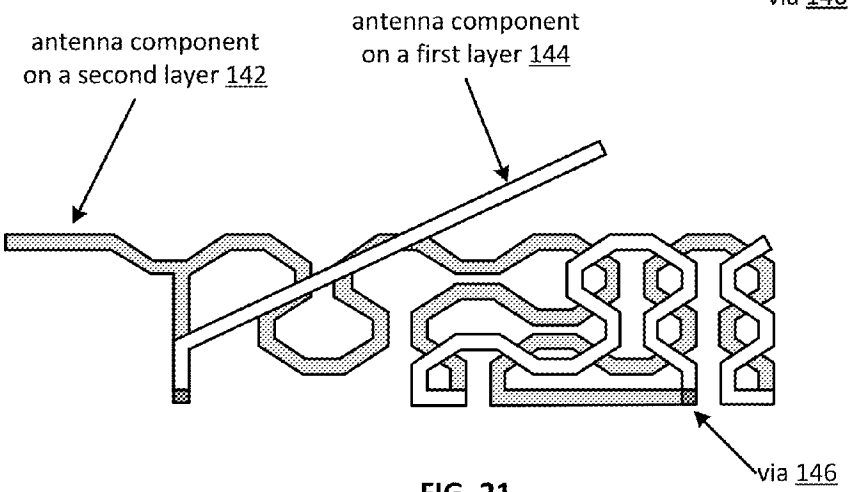
FIG. 21 is a diagram of another embodiment of a three-dimensional antenna apparatus in accordance with the present invention.

FIG. 21 is a top view (from a first layer perspective) diagram of another embodiment of a three-dimensional (3D) antenna apparatus that includes the first antenna component 142, the second antenna component 144, and the at least one via 146. In this illustration, the 3D antenna structure is a monopole antenna having multiple elements of the first antenna component 142 and one or more elements of the second antenna component 144. The multiple elements of the first antenna component 142 are coupled to the one or more elements of the second antenna component 144 by one or more vias 146. As is further shown in this illustration, the pattern of the first and second antenna components 142,144 is that of an ordered modified Polya curve confined in an arbitrary geometric shape.

Figure 22:
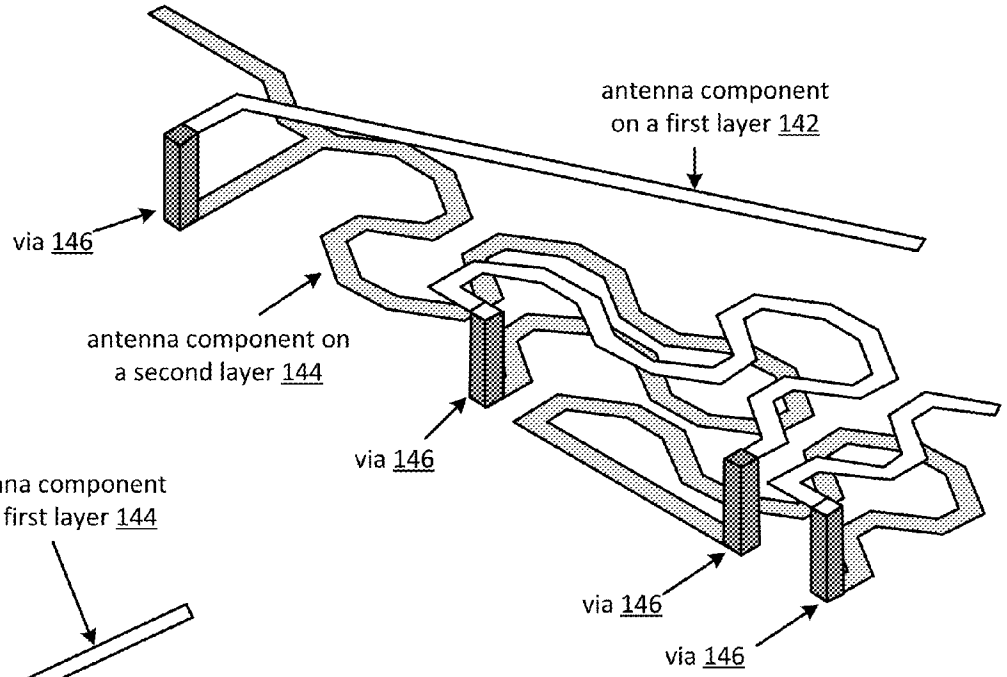
FIG. 22 is a diagram of another embodiment of a three-dimensional antenna apparatus in accordance with the present invention.

FIG. 22 is an isometric diagram of the embodiment of a three-dimensional antenna apparatus of FIG. 21. This diagram more clearly illustrates the electrical connection of the multiple elements of the first antenna component 142 to the second antenna component 144. As is further illustrated, the overlap angle is such that the first antenna component 142 substantially overlaps the second antenna component 144.

Figure 23:
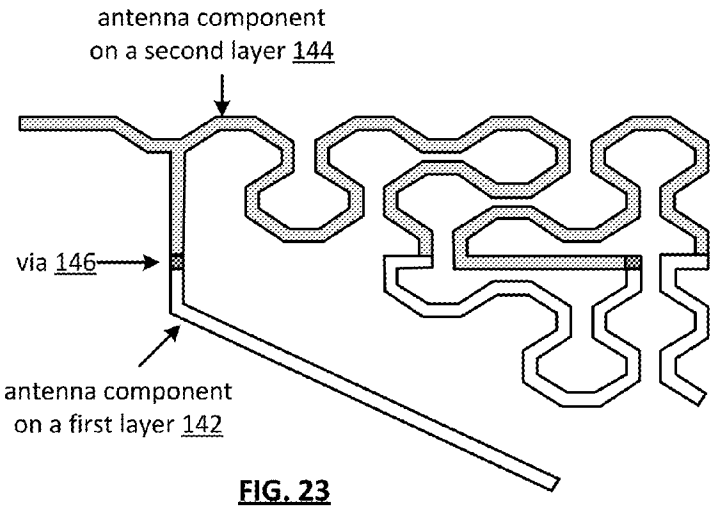
FIG. 23 is a diagram of another embodiment of a three-dimensional antenna apparatus in accordance with the present invention.

FIG. 23 is a diagram of another embodiment of a three-dimensional antenna apparatus that includes the first antenna component 142, the second antenna component 144, and the at least one via 146. In this illustration, the 3D antenna structure is a monopole antenna having multiple elements of the first antenna component 142 and one or more elements of the second antenna component 144. The multiple elements of the first antenna component 142 are coupled to the one or more elements of the second antenna component 144 by one or more vias 146 in a substantially non-overlapping manner (e.g., has an overlap angle of approximately 180°). As is further shown in this illustration, the pattern of the first and second antenna components 142, 144 is that of an ordered modified Polya curve confined in an arbitrary geometric shape.

Figure 24:
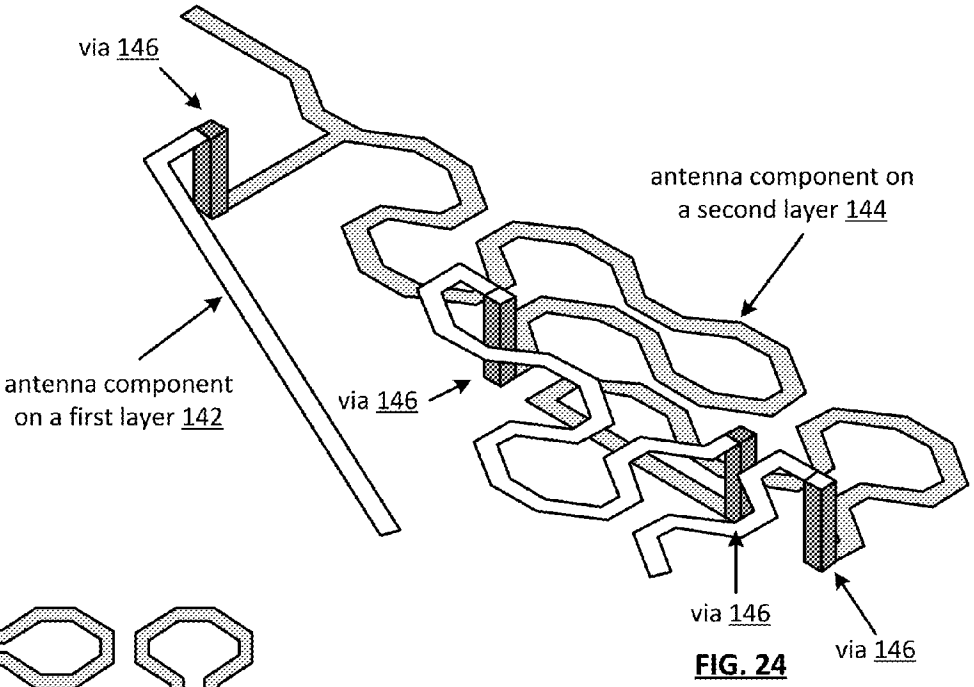
FIG. 24 is a diagram of another embodiment of a three-dimensional antenna apparatus in accordance with the present invention.

FIG. 24 is an isometric diagram of the embodiment of a three-dimensional antenna apparatus of FIG. 23. This diagram more clearly illustrates the electrical connection of the multiple elements of the first antenna component 142 to the second antenna component 144.

Figure 25:
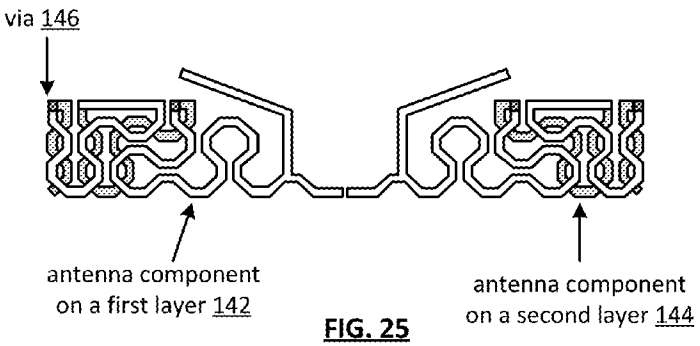
FIG. 25 is a diagram of another embodiment of a three-dimensional antenna apparatus in accordance with the present invention.

FIG. 25 is a diagram of another embodiment of a three-dimensional antenna apparatus a three-dimensional (3D) antenna apparatus that includes the first antenna component 142, the second antenna component 144, and the at least one via 146. In this illustration, the 3D antenna structure is a dipole antenna having multiple elements of the first antenna component 142 and one or more elements of the second antenna component 144 for each leg of the dipole antenna. The multiple elements of the first antenna component 142 are coupled to the one or more elements of the second antenna component 144 by one or more vias 146. As is further shown in this illustration, the pattern of the first and second antenna components 142, 144 is that of an ordered modified Polya curve confined in an arbitrary geometric shape.

Figure 26:
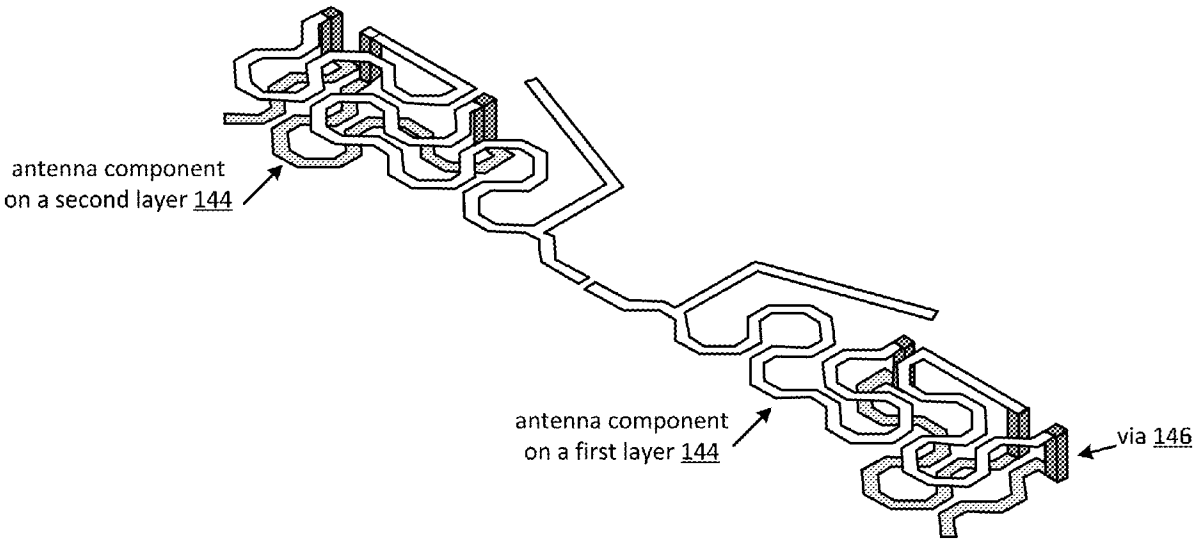
FIG. 26 is a diagram of another embodiment of a three-dimensional antenna apparatus in accordance with the present invention.

FIG. 26 is an isometric diagram of the embodiment of a three-dimensional antenna apparatus of FIG. 25. This diagram more clearly illustrates the electrical connection of the multiple elements of the first antenna component 142 to the second antenna component 144 for each leg of the dipole antenna. As is further illustrated, the overlap angle is such that the first antenna component 142 substantially overlaps the second antenna component 144 for each leg of the dipole antenna.

Figure 27:
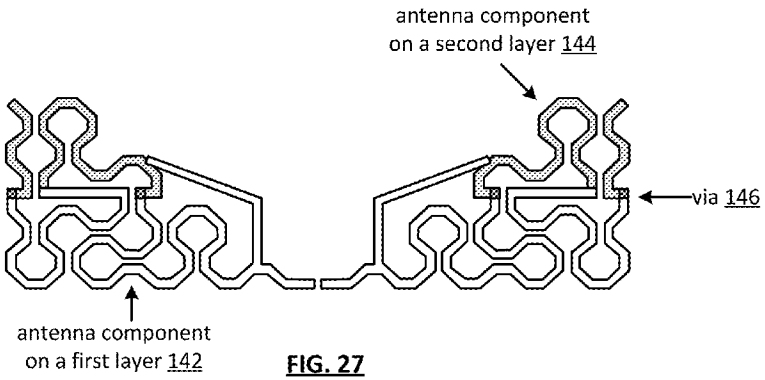
FIG. 27 is a diagram of another embodiment of a three-dimensional antenna apparatus in accordance with the present invention.

FIG. 27 is a diagram of another embodiment of a three-dimensional antenna apparatus that includes the first antenna component 142, the second antenna component 144, and the at least one via 146. In this illustration, the 3D antenna structure is a dipole antenna having multiple elements of the first antenna component 142 and one or more elements of the second antenna component 144 for each leg of the dipole antenna. For each leg, the multiple elements of the first antenna component 142 are coupled to the one or more elements of the second antenna component 144 by one or more vias 146 in a substantially non-overlapping manner (e.g., has an overlap angle of approximately 180°). As is further shown in this illustration, the pattern of the first and second antenna components 142,144 is that of an ordered modified Polya confined in an arbitrary geometric shape.

Figure 28:
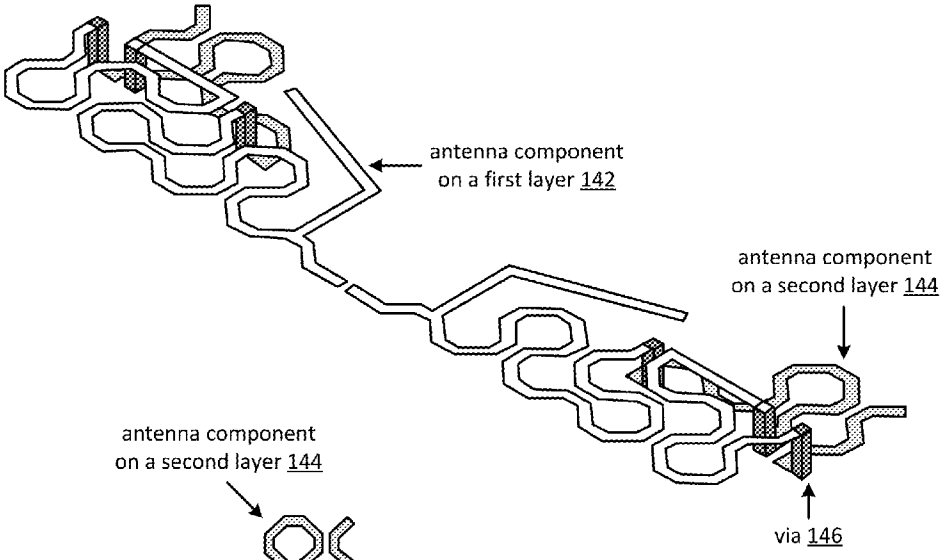
FIG. 28 is a diagram of another embodiment of a three-dimensional antenna apparatus in accordance with the present invention.

FIG. 28 is an isometric diagram of the embodiment of a three-dimensional antenna apparatus of FIG. 27. This diagram more clearly illustrates the electrical connection of the multiple elements of the first antenna component 142 to the second antenna component 144 for each leg of the dipole antenna.

The embodiments of three-dimensional antennas various embodiments of FIGS. 18-28 may be used in a various combinations to form a three-dimensional antenna array that includes a plurality of antenna structures. A first antenna structure of the plurality of antenna structures includes first and second antenna components and a via. The first antenna component is on a first substrate layer and the second antenna component is on a second substrate layer. The via couples the first antenna component to the second antenna component, wherein the first antenna overlaps, from a radial perspective, the second antenna component by a first angle of overlap.

A second antenna structure of the plurality of antenna structures includes third and fourth antenna components and a via. The third antenna component is on a third substrate layer and the fourth antenna component is on a fourth substrate layer. The via couples the third antenna component to the fourth antenna component, wherein the third antenna overlaps, from a radial perspective, the fourth antenna component by a second angle of overlap.

In an example, the antenna array is implemented on a substrate. The substrate includes at least two layers, where a first layer of the substrate constitutes the first and third substrate layers and a second layer of the substrate constitutes the second and fourth substrate layers. As such, the antenna structures of the antenna array are implemented on two (or more) layers of the same substrate. For instance, if one or more of the antenna structures includes a third antenna element (or more), then more than two layers of the substrate would be used.

In another example, the antenna array is implemented on multiple substrates. A first substrate supports the first antenna structure and a second substrate supports the second antenna structure. As such, the first antenna structure is implemented on two or more layers of the first substrate (e.g., an IC die or an IC package substrate) and the second antenna structure is implemented on two more layers of the second substrate (e.g., an IC die, an IC package substrate, a PCB, etc.). Note that each antenna structure of the array may operate in substantially the same frequency band, in different frequency bands, and/or a combination thereof.

As may be used herein, the terms "substantially" and "approximately" provides an industry-accepted tolerance for its corresponding term and/or relativity between items. Such an industry-accepted tolerance ranges from less than one percent to fifty percent and corresponds to, but is not limited to, component values, integrated circuit process variations, temperature variations, rise and fall times, and/or thermal noise. Such relativity between items ranges from a difference of a few percent to magnitude differences. As may also be used herein, the term(s) "operably coupled to", "coupled to", and/or "coupling" includes direct coupling between items and/or indirect coupling between items via an intervening item (e.g., an item includes, but is not limited to, a component, an element, a circuit, and/or a module) where, for indirect coupling, the intervening item does not modify the information of a signal but may adjust its current level, voltage level, and/or power level. As may further be used herein, inferred coupling (i.e., where one element is coupled to another element by inference) includes direct and indirect coupling between two items in the same manner as "coupled to". As may even further be used herein, the term "operable to" or "operably coupled to" indicates that an item includes one or more of power connections, input(s), output(s), etc., to perform, when activated, one or more its corresponding functions and may further include inferred coupling to one or more other items. As may still further be used herein, the term "associated with", includes direct and/or indirect coupling of separate items and/or one item being embedded within another item. As may be used herein, the term "compares favorably", indicates that a comparison between two or more items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1.

The present invention has also been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claimed invention.

The present invention has been described above with the aid of functional building blocks illustrating the performance of certain significant functions. The boundaries of these functional building blocks have been arbitrarily defined for convenience of description. Alternate boundaries could be defined as long as the certain significant functions are appropriately performed. Similarly, flow diagram blocks may also have been arbitrarily defined herein to illustrate certain significant functionality. To the extent used, the flow diagram block boundaries and sequence could have been defined otherwise and still perform the certain significant functionality. Such alternate definitions of both functional building blocks and flow diagram blocks and sequences are thus within the scope and spirit of the claimed invention. One of average skill in the art will also recognize that the functional building blocks, and other illustrative blocks, modules and components herein, can be implemented as illustrated or by discrete components, application specific integrated circuits, processors executing appropriate software and the like or any combination thereof.

What is claimed is:

1. A three-dimensional antenna structure comprises:

a first antenna component with a first modified Polya curve pattern on a first layer of a substrate;

a second antenna component with a second modified Polya curve pattern on a second layer of a substrate, wherein at least one of the first and second modified Polya curve patterns comprises a modified Polya curve with constant width and shaping factor, but varying order; and a via coupling the first antenna component to the second antenna component, wherein the first antenna component overlaps, from a radial perspective, the second antenna component by an angle of overlap.

2. The three-dimensional antenna structure of claim 1 further comprises:

the first antenna component having a first pattern in a first geometric shape; and the second antenna component has a second pattern in a second geometric shape.

3. The three-dimensional antenna structure of claim 1 further comprises:

a modification of the angle of overlap to modify operating characteristics of the antenna structure based on physical characteristics of the first and second antenna components and on the angle of overlap.

4. The three-dimensional antenna structure of claim 1 comprises a monopole antenna.

5. The three-dimensional antenna structure of claim 1 comprises a dipole antenna.

6. The three-dimensional antenna structure of claim 1, wherein the substrate comprises at least one of:

an integrated circuit (IC) die;

an IC package substrate; or a printed circuit board.

7. The three-dimensional antenna structure of claim 1 further comprises:

a plurality of vias to couple the first antenna component to the second antenna component, wherein the plurality of vias includes the via.

8. The three-dimensional antenna structure of claim 1 further comprises:

the first antenna component including a plurality of the modified Polya curve patterned antenna elements; and the second antenna component including one or more antenna elements.

9. The three-dimensional antenna structure of claim 1 further comprises:

a third antenna component on a third layer of the substrate; and a second via to couple the third antenna component to the first or the second antenna component.

10. A method of producing a three-dimensional antenna structure comprises:

forming a first antenna component with a first modified Polya curve pattern on a first layer of a substrate;

forming a second antenna component with a second modified Polya curve pattern on a second layer of a substrate, wherein at least one of the first and second modified Polya curve patterns comprises a modified Polya curve with constant width and shaping factor, but varying order; and coupling the first antenna component to the second antenna component with at least one via, wherein the first antenna component overlaps, from a radial perspective, the second antenna component by an angle of overlap.

11. The method of claim 10 further comprises:

forming the first antenna component having a first pattern in a first geometric shape; and forming the second antenna component has a second pattern in a second geometric shape.

12. The method of claim 10 further comprises:

modifying the angle of overlap to modify operating characteristics of the antenna structure based on physical characteristics of the first and second antenna components and on the angle of overlap.

13. The method of claim 10, wherein the substrate comprises at least one of:

an integrated circuit (IC) die;

an IC package substrate; or a printed circuit board.

14. The method of claim 10 further comprises:

coupling the first antenna component to the second antenna component with a plurality of vias, wherein the plurality of vias includes the via.

15. The method of claim 10 further comprises:

the first antenna component including a plurality of the modified Polya curve patterned antenna elements; and the second antenna component including one or more antenna elements.

16. The method of claim 11, wherein at least one of the first and second geometric shapes comprises an orthogonal triangle.

17. The three-dimensional antenna structure of claim 2, wherein at least one of the first and second geometric shapes comprises an orthogonal triangle.

18. The three-dimensional antenna structure of claim 2, wherein at least one of the first and second geometric shapes comprises a triangle with a length-to-area ratio in the range of 4-to-1 to 7-to-1.

* * * * *